US009085912B2

(12) United States Patent
Brady

(10) Patent No.: US 9,085,912 B2
(45) Date of Patent: Jul. 21, 2015

(54) BACK PLATE BRACKETING SYSTEM

(71) Applicant: Todd A. Brady, Beverly Hills, CA (US)

(72) Inventor: Todd A. Brady, Beverly Hills, CA (US)

( * ) Notice: Subject to any disclaimer, the term of this patent is extended or adjusted under 35 U.S.C. 154(b) by 0 days.

(21) Appl. No.: 14/038,618

(22) Filed: Sep. 26, 2013

(65) Prior Publication Data

US 2015/0082737 A1 Mar. 26, 2015

(51) Int. Cl.

| | |
|---|---|
| ***E04C 2/34*** | (2006.01) |
| ***E04C 3/30*** | (2006.01) |
| ***E04C 5/01*** | (2006.01) |
| ***E04G 23/02*** | (2006.01) |

(52) U.S. Cl.
CPC ..... *E04G 23/0222* (2013.01)

(58) Field of Classification Search
CPC ..... E04G 23/0222
USPC ..... 52/481.1, 653.1, 655.1, 696, 698, 713
See application file for complete search history.

(56) References Cited

U.S. PATENT DOCUMENTS

| | | | | |
|---|---|---|---|---|
| 5,189,857 | A * | 3/1993 | Herren et al. | 52/317 |
| 6,138,425 | A * | 10/2000 | Wendt | 52/506.07 |
| 6,253,529 | B1 * | 7/2001 | De Boer | 52/763 |
| 6,705,056 | B2 * | 3/2004 | Tollenaar | 52/317 |
| 7,213,377 | B1 * | 5/2007 | Sackett | 52/696 |
| 7,331,149 | B2 * | 2/2008 | Tollenaar | 52/481.1 |
| 7,520,100 | B1 * | 4/2009 | Herrman et al. | 52/481.1 |
| 7,739,852 | B2 * | 6/2010 | Brady | 52/696 |
| 8,141,319 | B2 * | 3/2012 | Brady | 52/655.1 |
| 8,281,544 | B2 * | 10/2012 | Brady | 52/745.13 |
| 8,689,508 | B2 * | 4/2014 | Orszulak et al. | 52/317 |
| 2002/0139079 | A1 * | 10/2002 | Brady | 52/653.1 |
| 2004/0154259 | A1 * | 8/2004 | Brady | 52/633 |
| 2005/0066611 | A1 * | 3/2005 | Brady | 52/633 |
| 2005/0257472 | A1 * | 11/2005 | Brady | 52/474 |
| 2006/0174583 | A1 * | 8/2006 | Brady | 52/731.7 |
| 2009/0217603 | A1 * | 9/2009 | Brady | 52/127.1 |
| 2010/0139203 | A1 * | 6/2010 | Brady | 52/655.1 |
| 2010/0236187 | A1 * | 9/2010 | Brady | 52/745.13 |
| 2014/0000208 | A1 * | 1/2014 | Vanker et al. | 52/655.1 |
| 2014/0290176 | A1 * | 10/2014 | Rice | 52/696 |

* cited by examiner

*Primary Examiner* — Jeanette E Chapman
*Assistant Examiner* — James Buckle, Jr.
(74) *Attorney, Agent, or Firm* — Trojan Law Offices

(57) ABSTRACT

A bracketing system is provided having two brackets joined by an adhesive material that allows a bridge backing member to be mounted between vertical studs to enhance stability of the wall construction. A wall construction assembly according to an embodiment of the invention comprises two vertical studs and a bridge backing member mounted there between by a bracketing system, which includes a left bracket and a right bracket connected by a flexible adhesive material. The bridge backing member has curved flanges that are shorter in length than the web of the bridge backing member. This bridge backing member can then hook securely over the brackets, and abut the vertical studs. The hooking of the bridge backing member of the brackets and shorter flanges allows the bridge backing member to rest on the brackets without the installer having to manually hold the bridge backing member between the studs prior to attachment.

14 Claims, 5 Drawing Sheets

BACK PLATE BRACKETING SYSTEM

BACKGROUND OF THE INVENTION

1. Field of the Invention

This invention relates to a wall construction assembly and, more particularly, to a bracketing system for assembling horizontal members to vertical studs.

2. Background Information

In a conventional wall frame assembly, a wall is constructed from a combination of horizontal members (or otherwise known as backing plates) affixed to vertical studs to form a frame structure onto which drywall or other types of wallboards are attached. Horizontal members and vertical studs are typically of a C-channel or U-channel flat strap stock variety, having a web connecting two flanges. Horizontal members can function as backing support by being installed transversely between vertical studs to provide enhanced lateral and vertical stability for the wall. Horizontal members can also function as reinforced backing to support heavy loads, such as from the mounting of heavy equipment on the wall to provide backing to anchor equipment. For example, when large medical equipment sinks are wall mounted in a hospital, a backing plate of sufficient load capacity is required to support it. Like bridging members, such backing plates are mounted transversely between vertical studs to provide enhanced stability to support dead loads and pull out loads.

Prior to the present invention, a horizontal member (referred herein alternately as bridging, backing or bridge backing member) would be affixed directly to the vertical studs, generally by means of attachment screws and/or weld. The horizontal member must be welded to account for poor design and construction tolerances. The direct assembly of horizontal members to vertical studs presented a number of problems.

First, though wall studs are typically installed at set intervals (e.g. 16 inch on center spacing), often there is variation in the spacing. Because of the variable spacing between studs, it is difficult to prefabricate (stock) bridge backing members to universally fit between the studs. Bridge backing members are manufactured in oversized stock lengths that must usually be cut to fit at the job site. The time and labor required to cut bridge backing members to custom fit the particular application greatly increase construction costs.

One attempt to overcome the problem of fitting a bridging or backing member between variably spaced studs is disclosed in U.S. Pat. No. 4,717,101 to Harrod, which teaches an adjustable backing board. The invention disclosed by Harrod is comprised of two interfitted rectangular channel pieces, telescoped together, with one piece being slideably mounted within the larger channel such as to be adjustable therein. Similarly, U.S. Pat. No. 4,658,556 to Jenkins teaches a system of expandable and retractable backing spans for fitting between studs. Both patents are directed to adjustable backing members, rather than to a bracketing system for mounting standardized backing members, and both require complex engineering to make the backing members adjustable.

A second problem with attaching bridge backing members directly on vertical studs is that, because the backing members are cut from stock channels, the backing members have no end surfaces that can be fastened to the vertical studs. As a consequence, in order to attach a bridge backing member between two studs, it is generally necessary to cut the ends of the flanges on the backing member so that the web of the bridge backing member can be fastened over the vertical studs. That is, the flanges must be cut to fit between the studs, such as to leave corresponding sections of the web on either end to overlap with the sides of the vertical studs. For example, in U.S. Pat. No. 1,867,449, Ecket et al. teaches a bridging member for positioning between studs variably spaced apart, in which the ends of the bridging member must be cut inwardly to provide a securing plate for attaching to the studs. The drawback of having to custom cut each bridge backing member in this way to fit between the studs is the increase in construction time and cost.

A third problem with the direct assembly of bridge backing members to vertical studs is that it often resulted in cosmetic problems because it created bulges in the wallboard, which required additional labor and material to correct by finishing over the uneven surface of the wall. The problem resulted from the fact that when the backing member is mounted directly on the studs, the web of the backing member sits over the side flanges of the studs which, plus the buildup of the screw, created an uneven surface. In order to eliminate this problem of an uneven surface resulting from the direct attachment of the screw on the stud surface, a backing member would have to be mounted flush with the sides of the vertical studs.

U.S. Pat. No. 5,189,857 to Herren et al. teaches a flush mount bridging and backing plate having a traverse end plate at one end of the channel and a Z-shaped tongue at the opposite end of the channel. The tongue fits between the two flanges of a stud, thereby allowing the backing plate to be mounted flush with the sides of the stud. The end plate and tongue provide end tabs so that the backing plate can be mounted directly onto the studs' web without having to cut the flanges on the backing plate as described above. However, one major disadvantage of backing plates having prefabricated end tabs is that it is still required to mount directly to the studs without the ability to adjust to uneven stud layout. Because of the variable spacing between studs, stock backing members having prefabricated end tabs do not always fit between studs that are variably spaced apart. If in a particular application the studs are too wide or too narrow apart, such stock backing plates having prefabricated end tabs do not fit. Furthermore, it is more costly to manufacture backing plates with Z-shaped end tabs that are not adjustable.

A fourth problem with current horizontal bridge backing members is that often the installer must manually hold the bridge backing member in place before connecting the bridge backing member to the vertical studs. Manually holding the bridge backing member to the brackets (instead of having a structure that holds the bridge backing member in place) may lead to inaccurate placement of the bridge backing member since the installer may strain to manually hold and align the bridge backing member to the studs while trying to also securing the bridge backing member to the studs. Complicating the matter, any type of holding element that holds and stabilizes the bridge backing member on the bracket without the installer manually holding the bridge backing member in place might be encumbered by protrusions on the bracket used to accommated flanges on the vertical studs. For example, U.S. Pat. No. 7,739,852 to Brady teaches a horizontal bridge backing member attached to two brackets mounted between two vertical studs. However, the horizontal backing member is not flush between the two vertical studs because a lip that extends from the flange of the bracket prevents full extension of the horizontal backing member to the edge of each flange of the vertical stud.

In sum, the standard practice in the art is to mount backing members directly onto and over studs, which results in the disadvantages described above. For the foregoing reasons, there is a need for a bracketing system that can mount horizontal bridge backing members with vertical studs. There is a need for a cost-effective installation method for a bracketing system that can mount stock bridging or backing members between variably spaced studs without the need to cut each individual member to fit between the studs. There is a need for a bracketing system that can mount bridge backing members without having to cut the flanges of the members to create end tabs for mounting on the studs. There is a need for a bracketing system that can allow for a bridge backing member to mount flush with the stud, so as to eliminate cosmetic unevenness in the wall structure. There is a need for a bracketing system that can allow for a bridge backing member to fully extend from one vertical stud to a second vertical stud. By extending from one stud to a second stud, the amount of gap space between the internal edges of the vertical studs and the edge of the horizontal member is reduced. There is a need for a bracketing system that can allow easy mounting of a horizontal bridge on brackets without the need to manually hold and position the horizontal bridge backing member before securing the bridge backing member to the brackets. The claimed invention avoids the above problems and provides significant savings in material and labor costs (e.g. scrap (leftover) materials can be used as bridge backing between studs and on said bracketing system).

SUMMARY OF THE INVENTION

The present invention is directed to a bracketing system that allows for adjustably connecting building components in a building construction.

It is a purpose of the present invention is to provide a bracketing system for adaptable on-site installation of bridging or backing members between variably spaced vertical studs. This bracketing system comprises two brackets held together by an adjustable adhesive material. The bracketing system can be mounted onto the vertical studs of a wall construction for supporting a bridging or backing member there between.

It is a purpose of the present invention is to provide an efficient method of indirectly mounting bridging or backing members between vertical studs that will eliminate the need for attaching the bridging or backing members directly on the vertical studs.

It is another purpose of the present invention to provide a bracketing system that will reduce the time, labor, and material required for mounting bridging or backing members by eliminating the need to cut each (pre-fabricated or stock) member to fit between variably spaced studs.

Another purpose of the present invention is to provide a bracketing system that will reduce the time, labor, and material required for mounting bridging or backing members by eliminating the need to cut each member to create end tabs for attaching directly on the vertical studs.

Still a further purpose of the present invention is to provide an efficient method of mounting bridging or backing members with vertical studs that will enhance the structural stability of the wall frame construction and mounting equipment thereto.

Still a further purpose of the present invention is to provide a bracketing system that can accommodate bridging or backing members of various widths and lengths.

Still a further purpose of the present invention is to provide a bracketing system that allows a bridging member to be hooked over the brackets in order to position the bridging member prior to attachment without manually holding the bridging member in place during attachment.

The present invention introduces such refinements. In a preferred embodiment of the invention, the bracketing system comprises a left bracket and a right bracket joined by an adhesive material. The designation "left" and "right" is for ease of reference only and is not intended to limit the orientation of the brackets. The left bracket has a reverse L-shape, with a first left plate joined at a right angle to a second left plate. Mirroring the left bracket, the right bracket has an elongated L-shape, with a first right plate joined perpendicularly at right angle to an elongated second right plate. In an embodiment of the invention, the second right plate is formed with a groove that runs along its length parallel to the first right plate. The groove divides the second right plate of the right bracket substantially into two halves.

The left bracket is joined to the right bracket by a removable adhesive adjustable tap. The removable adhesive attaches to the respective second left plate and second right plate of the two brackets, such that the two second plates are substantially co-planar with each other.

To mount a bridge backing member to a vertical stud, the bracketing system is first installed on the stud. In a preferred method of installing the bracketing system, the left bracket is placed in a desired vertical location on the stud, with the first left plate mating to the web of the stud. The right bracket is then peeled from the adhesive, such that the exposed adhesive attaches to a flange on the stud. The right bracket is wrapped around the flange of the stud. In this configuration, the respective first left plate and first right plate of the two brackets will sandwich the web of the stud, while the respective second left plate and second right plate are substantially co-planar. One half of the second right plate of the right bracket will mate with the inside surface of the flange. The other half of the second right plate of the right bracket extends beyond the flange of the stud for mounting with a bridge backing member. The adhesive material functions to temporarily hold the two brackets in place with the stud while a screw or other attachment means is passed through the first left plate and first right plate sandwiching the stud web in order to attach the brackets to the stud.

For a vertical stud having a C-channel frame section with lips on the flanges, the bracketing system must be mounted in a manner that accommodates the lips of the flanges. When the right bracket is wrapped around the flange of the stud, the groove on the second right plate of the right bracket accommodates the lip on the flange of the stud. With the groove accommodating the lip of the flange, the first right plate mates to an inside surface of the web of the stud, sandwiching the web between the first left plate and the first right plate. One half of the second right plate of the right bracket will mate with an inside surface of the flange, with the lip of the flange accommodated by the groove on the second right plate. Again, a screw or other attachment means is used to secure the first left plate and first right plate to the stud.

Conversely, the bracketing system can be installed by first attaching the right bracket to the stud. The first plate of the right bracket mounts to the inside face of the web on the stud. When the right bracket first plate mounts to the inside web, one half of the second right plate mounts to the inside face of the flange on the stud, with the groove accommodating the lip of the flange, and the other half of the second right plate extending outward. The first left plate of the left bracket then mounts to the outside face of the web on the stud, such that the respective first plates of the two brackets sandwich the web of the stud. Metal screws or other attachment means are used to attach the respective first left plate and first right plate to the web of the stud, and screws can be used to also attach the second right plate of the right bracket to the flange of the stud.

With pairs of brackets mounted to each stud at a corresponding elevation, a bridge backing member can be mounted between the brackets. The bridge backing member can be mounted to the face of the second plates of the respective brackets such that the web of the backing member is flush with the flange of the stud. Because the backing member can be movably positioned on the brackets, the backing member (cut from stock or scrap materials) can be adjusted to fit between the studs regardless of any variation in the spacing of the studs. This obviates the need to notch the stock backing member to fit between variably spaced studs. This also obviates the need notch each stock backing member to create end tabs for mounting with the studs.

Bridge or backing members of various widths can be mounted to the bracketing system. In one embodiment of the invention, the flanges of the bridge backing member can mount over and under the respective top and bottom edges of the second left plate or second right plate. For bridge backing members having narrower (generally 3⅝, 4 or 6 inches) widths, the left and right brackets are provided with notches in the second left plate and second right plate. The flanges of the bridge backing member can be inserted into the notches of the brackets. For example, one flange of the bridge backing member can insert into corresponding notches on the second left plate and second right plate, of the respective second plates. Alternatively, flange of the bridge backing member can insert into corresponding notches on the second left plate and second right plate with the other flange mounted under the bottom edge on the second left plate and second right plate. Or both flanges of the bridge backing member can insert into notches in the second left plate or second right plate. Once the bridge backing member is mounted to the brackets, screws or other attachment means can be used to secure it to the brackets. In this way, a backing member can be mounted between sets of brackets attached to the studs.

The bridge backing member can be mounted between the vertical studs by first hooking the bridge backing member over the brackets. The bridge backing member can be hooked over the brackets via of a flange that does not extend the full length of the bridge backing member so that the flanges do not overlap any protrusion on the brackets. The flanges of the bridge backing member can be curved to fit over, and hold securely, the bridge backing member to the brackets between the vertical studs. The web of the bridge backing member can extend to the flanges of the vertical studs since the flanges of the bridge backing member are of a shorter width than the web of the bridge backing member.

While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

BRIEF DESCRIPTION OF THE DRAWINGS

The above and various other objects and advantages of the invention will be described and understood from the following detailed description of the preferred embodiment of the invention, the same being illustrated in the accompanying drawings.

DETAILED DESCRIPTION OF THE PREFERRED EMBODIMENT

Figure 1:
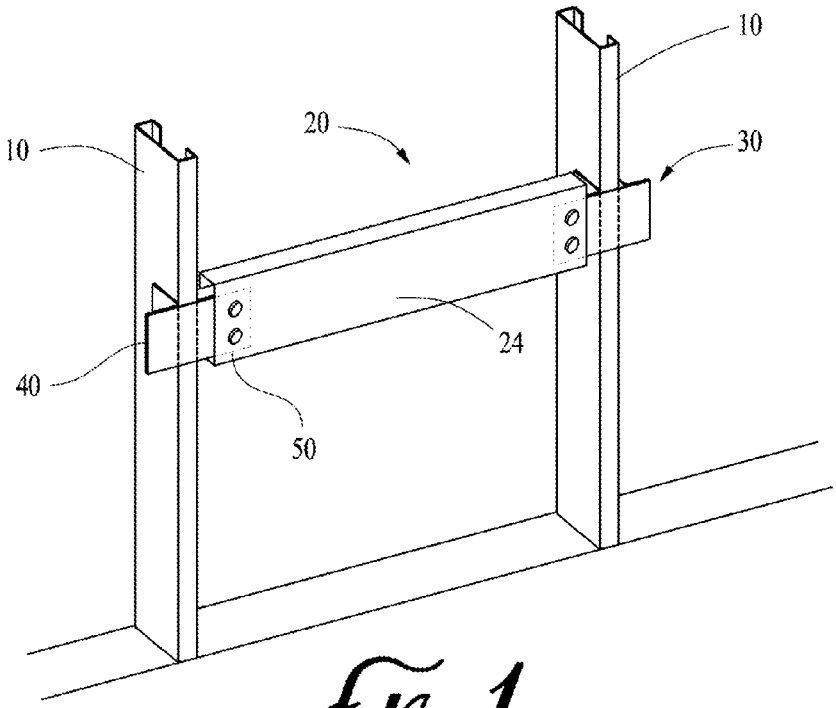
FIG. 1 (PRIOR ART)
FIG. 1 is a front perspective view of an embodiment of a bridge backing member attached to vertical studs found in the prior art.
Figure 4:
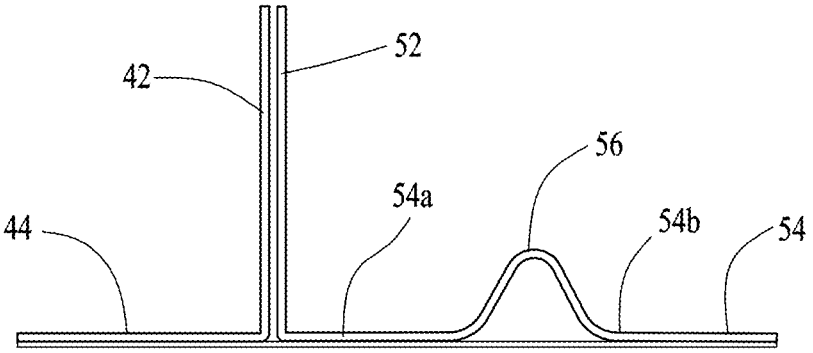
FIG. 4 is a top view of a bracketing system shown in a closed configuration.
Figure 5:
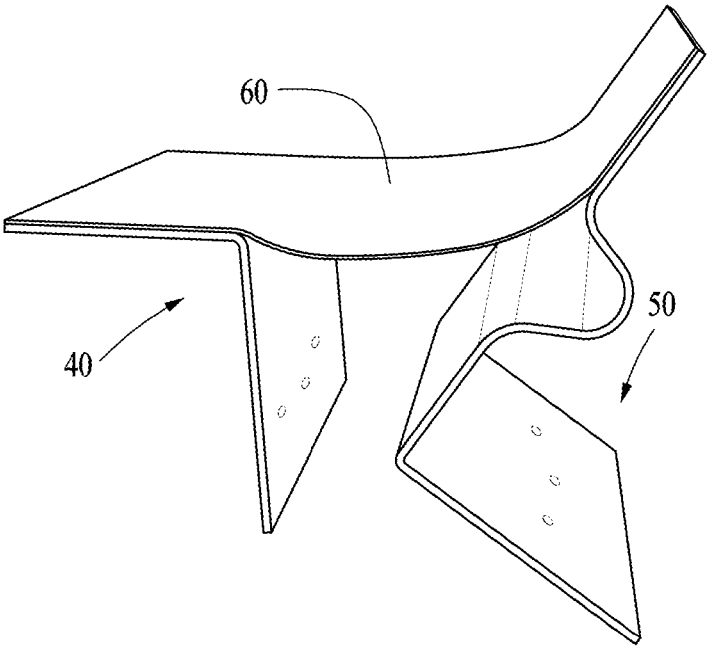
FIG. 5 is a perspective view of a bracketing system shown in an opened configuration.

A building construction assembly in the prior art is shown in FIG. 1. Referring to FIG. 1, a bridge backing member 20 is mounted between two vertical studs 10 by bracketing systems 30. Both vertical stud 10 and bridge backing member 20 are made of common channel stock of the C-channel or U-channel variety, having in common two flanges 12 joined by a web 14 to form a channel frame. For a C-channel frame as shown in FIG. 4, each flange 12 has lip 13. It would be understood by one of ordinary skill in the art that the bracketing system 30 described herein can work for its intended purpose with either C-channel or U-channel frames.

FIG. 1 shows a bridge backing member 20 mounted between two bracketing systems 30. Bracketing system 30 is mounted to each of two vertical studs by 10 attachment means 70 (shown in FIG. 6). As shown more particularly in FIGS. 2 and 3, each bracketing system 30 includes a left bracket 40 and a right bracket 50 connected by adhesive material 60. The "left" and "right" designations are for ease of reference only and are not meant to limit the orientation of the respective brackets. Left bracket 40 has a first left plate 42 joined to a second left plate 44. Right bracket 50 has a first right plate 52 joined to an elongated second right plate 54. The second right plate 54 has a groove 56 therein that runs substantially along its length and parallel to first right plate 52, dividing second right plate 54 into two sections, 54*a* and 54*b*. Left bracket 40 is connected to right bracket 50 by adhesive material 60 that attaches to the sides of second left plate 44 and second right plate 54, such that second left plate 44 and second right plate 54 are substantially coplanar as shown in FIG. 4.

Figure 2:
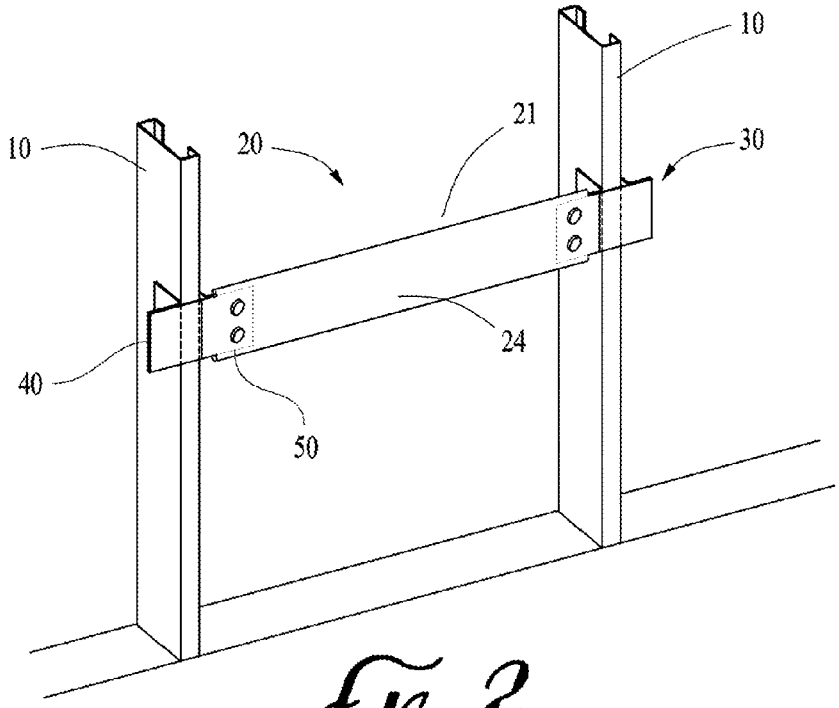
FIG. 2 is a front perspective view of an embodiment of the invention.
Figure 3:
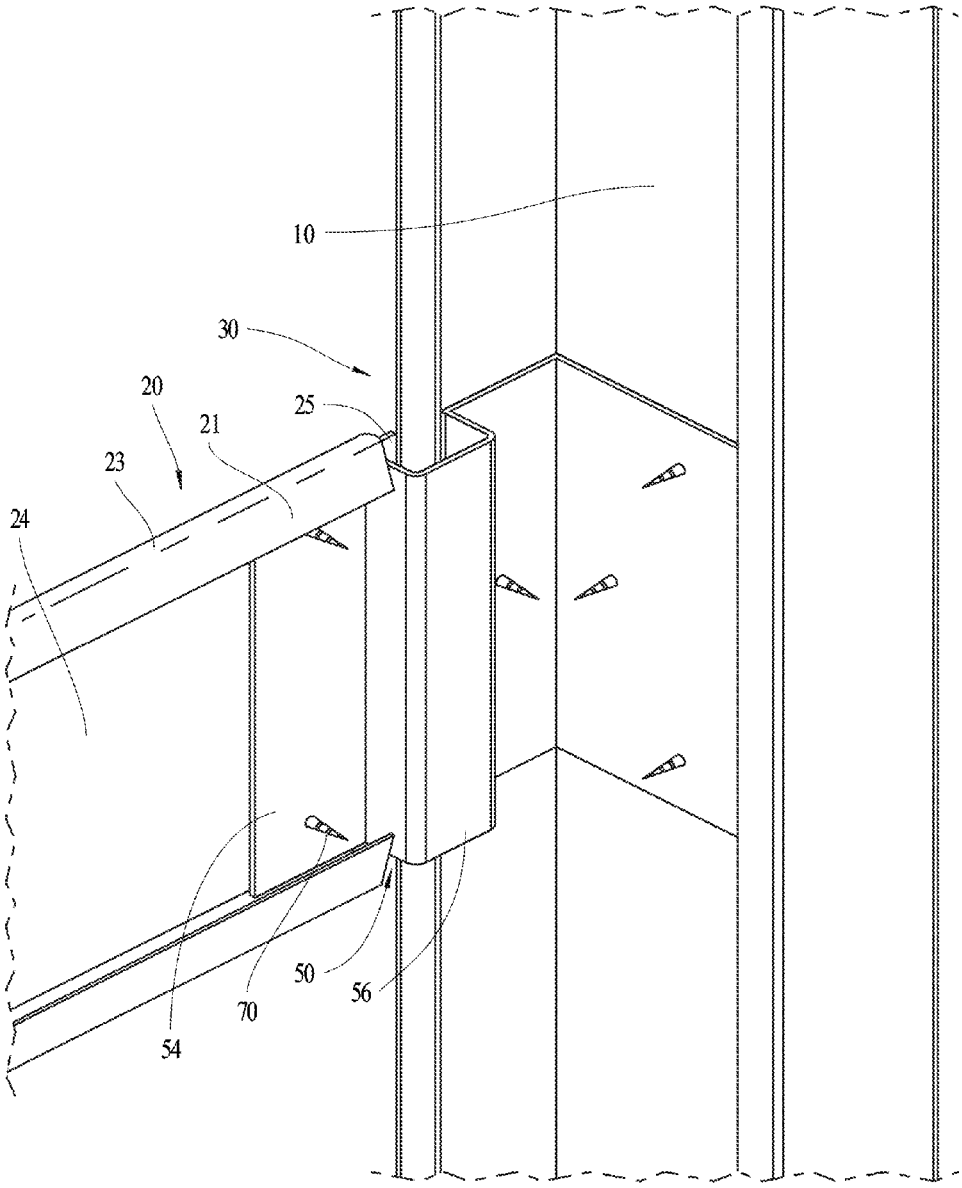
FIG. 3 is a rear perspective view of an embodiment of the invention.

Again referring to FIG. 1, in the prior art, a bracketing system 30 is mounted on a first vertical stud 10. Another bracketing system 30 is mounted on a second vertical stud 10. A bridge backing member 20 is mounted between the two bracketing systems 30. FIG. 2, and FIG. 3 show two views an improvement upon the prior art shown in FIG. 1. FIGS. 2 and 3 shows the bracketing system 30 hooked onto the left and right brackets 40, 50 by having the flange 21 of the bridge backing member 20 connected by a curved structure 23 so as to hook onto the left and right bracket 40, 50. The curved structure 23 arc connects the flange 21 to the web 24 of the bridge backing member 20. The curved flange 21 of the bridge backing member 20 allows the installer to latch the bridge backing member 20 onto the left and right attachments 40, 50, and place the bridge backing member 20 into the correct position before attaching the bridge backing member via attachment means.

The curved flanges 21 of the bridge backing member 20 and the web 24 of the bridge backing member 20 form an outer boundary of an inner channel that runs substantially along the length of the bridge backing member 20. The inner channel is characterized as having a depth such that the attachment plates can extend to the ends of the bridge backing member 20. When the depth of the inner channel is substantially similar to the thickness of the brackets 40, 50, the bridge backing member hooks snugly over the brackets 40, 50. In the prior art of FIG. 1, the bridge backing member 20 had to be held in place while using the attachment means 70 because of the lack of the curved flange 23, which holds the bridge backing member 20 in the correct position without manual holding the bridge backing member 20 using the attachment means 70. This is advantageous because it allows the installer to focus attaching the bridge backing member to the attachment brackets 40, 50 without also having to focus on maintaining the position of bridge backing member 20 at the same time because the bridge backing member 20 is hooked and secured in position before the installer uses the attachment means 70 to attached the bridge backing member 20 to the attachment brackets 40, 50.

Another advantage of the embodiment illustrated in FIGS. 2 and 3 is that the webbing 24 of the bridge backing member 20 can extend to the edge of each vertical stud 10, leading to a flush transition from the bridge backing member 20 to each stud 10. In the prior art, the bridge backing member 20 was prevented from fully extending to each stud 10 of a protruding groove 56. However, as shown in FIGS. 2 and 3, the curved flange 21 extends to the groove 56, but the webbing 24 extends all the way through the stud 10 since the flange 21 has a cut-out section near where the groove 56 of the right attachment bracket 50 begins. Without this cut-out section, the curved flange 21 would not be able to rest over the second right plate 54 since if the second right plate 54 were fully extended to the vertical stud 10, the groove 56 would block the curved flange 21 from hooking over the entirety of the right attachment plate 50. The bridge backing member 20 has an extended section 25 that is flush and abutted to, or nearly abutted to flanges 12 on the vertical studs 10. This configuration creates a more aesthetic clean look, and also is more stable since the ends of the bridge backing member 20 are in closer proximity to the vertical studs 10.

Figure 6:
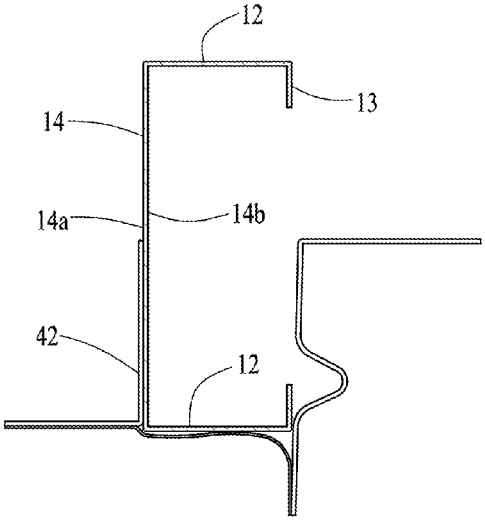
FIG. 6 is a top sectional view of a bracketing system and a vertical frame member.
Figure 7:
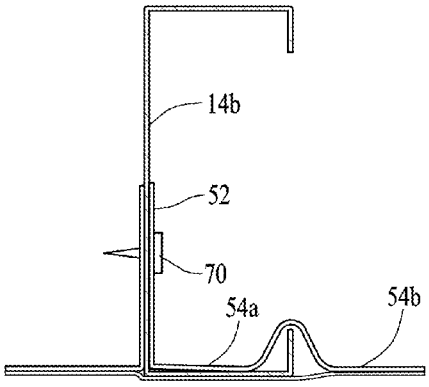
FIG. 7 is a top sectional view of the bracketing system engaged with a vertical frame member.
Figure 8:
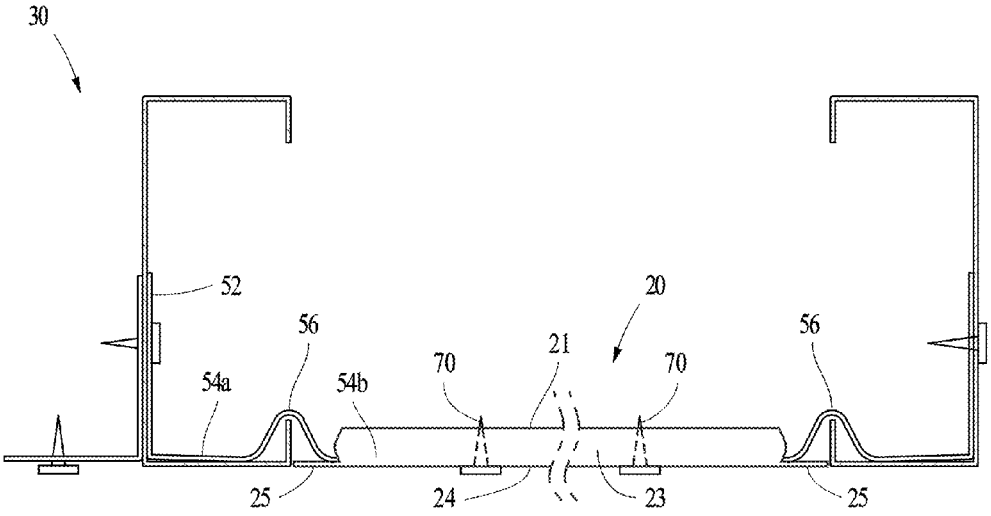
FIG. 8 is a top sectional view of an embodiment of the invention.

Referring more particularly to FIGS. 6 and 7, in order to mount bracketing system 30 on vertical stud 10, left bracket 40 is placed on vertical stud 10 with first left plate 42 mating with first surface 14*a* of web 14 of vertical stud 10. To facilitate assembly of bracketing system 30 on vertical stud 10, adhesive material 60 can be applied to a flange 12 of vertical stud 10 to hold bracketing system 30 in place while left bracket 40 and right bracket 50 are secured to vertical stud 10. The right bracket 50 is wrapped around flange 12 of vertical stud 10, such that first right plate 52 mates with second surface 14*b* of web 14 of vertical stud 10. In this configuration, first left plate 42 and first right plate 52 sandwich web 14 of vertical stud 10 and second left plate 44 is substantially coplanar with second right plate 54 as shown in FIG. 7. An attachment means 70 is passed through the first right plate 52, the web 14, and the first left plate 42 to mount bracketing system 30 to vertical stud 10 as shown in FIG. 8. Or, conversely, the attachment means can be applied in an opposite orientation.

FIGS. 6 and 7 show the assembly of bracketing system 30 onto a vertical stud 10 having a C-channel cross-section, wherein flange 12 has lip 13. For a vertical stud 10 having a C-channel cross-section, right bracket 50 is wrapped around vertical stud 10 with groove 56 accommodating lip 13 on vertical stud 10. Again, web 14 of vertical stud 10 is sandwiched between first left plate 42 and first right plate 52. First right plate 52 mates with second surface 14*b* of web 14, and section 54*a* of second right plate 54 mates with an inside surface of flange 12. Section 54*b* of second right plate 54 extends beyond lip 13 of vertical stud 10, so as to allow mounting of a bridge backing member 20 thereon as shown in FIG. 8. It should be noted that though FIGS. 6 and 7 show the mounting of bracketing system 30 to a vertical stud having a C-channel cross-section, it would be understood by one of ordinary skill in the art that the above method of mounting bracketing system 30 would work equally well with any stock channel frame, including studs having a U-channel cross-section.

Referring to FIG. 8, after bracketing system 30 is mounted to vertical stud 10, a bridge backing member 20 can be mounted to bracketing system 30. In order to mount bridge backing member 20 on bracketing system 30, the bridge backing member 20 is attached to the second left plate 44 of left bracket 40 at one end and to section 54*b* of second right plate 54 of right bracket 50 at the other end. Attachment means 70 is used to fasten bridge backing member 20 on bracketing system 30.

Figure 9:
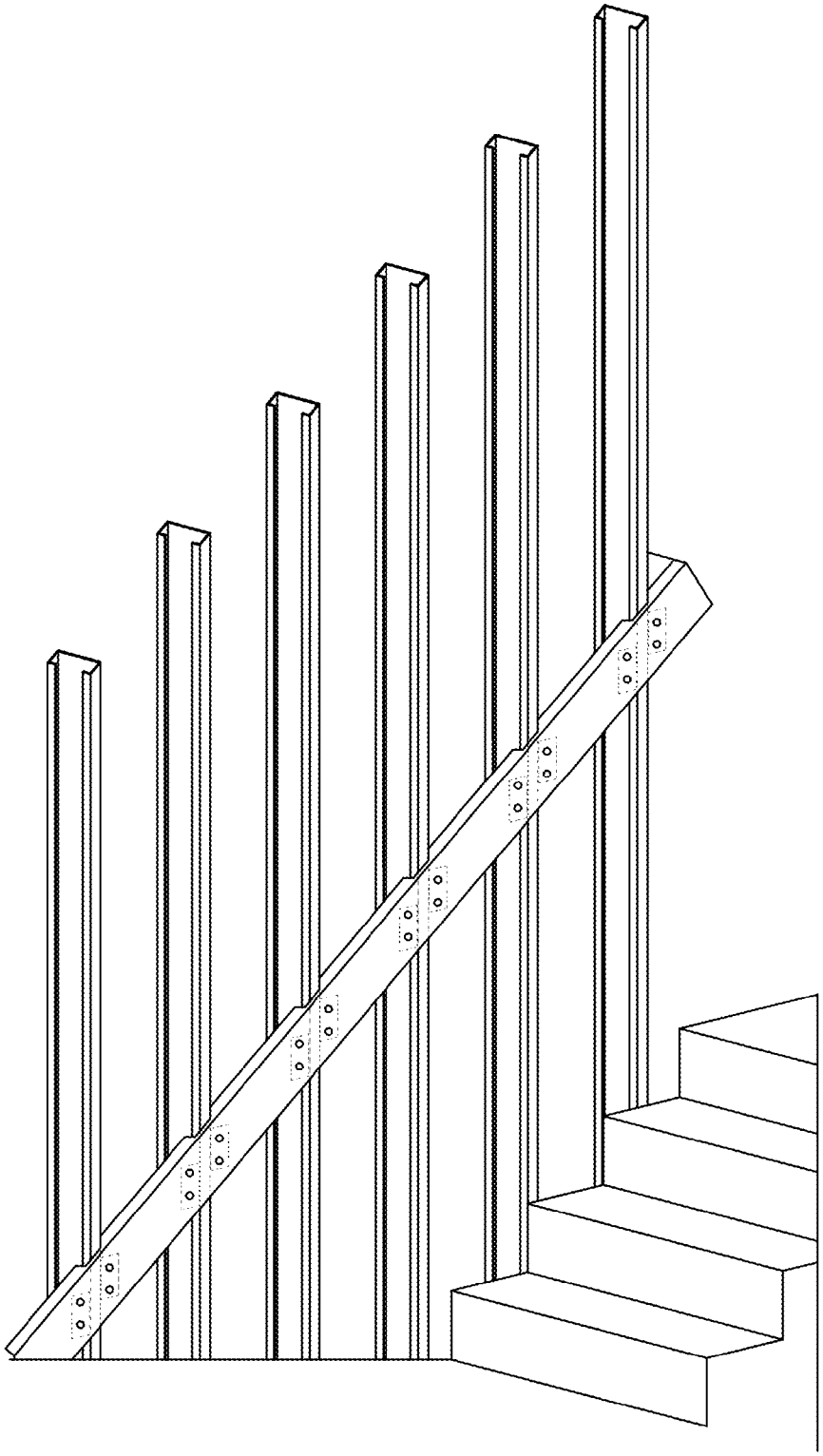
FIG. 9 is a perspective view of an embodiment of the invention, showing a bridge backing member mounted at an angle to the vertical frame members.

As described herein, in a preferred embodiment of the invention, left bracket 40 and right bracket 50 are mounted to a vertical stud 10 such that left bracket 40 and right bracket 50 are on substantially the same elevation, as shown in FIGS. 1 and 2. However, referring to FIG. 9, which shows another embodiment of the invention, left bracket 40 and right bracket 50 can be mounted to a vertical stud 10 in a stepped configuration. In this configuration, the bridge backing member 20 can be mounted diagonally or at some angle with respect to vertical studs 10.

When the brackets 40, 50 are screwed to the stud 10, the adhesive material 60 can be pulled off. The bridge backing member 20 can then be mounted to the face of the second plates 44, 54 of the respective brackets 40, 50 such that the web 24 of bridge backing member 20 is co-planar with the flange 12 of the stud 10. However, in the prior art shown in FIGS. 2 and 3, not only is the bridge backing member 20 coplanar with the flanges 12 of the studs 10 (as they are in embodiments of the prior art, as shown in FIG. 1), but are also abutted and flush with the vertical studs 10, which the prior art is not.

I claim:

1. A building construction assembly comprising:

at least two first vertical members, each of said first vertical members having two first vertical member flanges joined by a first web to form a first channel frame;

a second member for mounting between said two first vertical members, said second member having two curved horizontal member flanges joined by a second web to form a second channel frame, said second web having a length greater than the length of each of said two horizontal member flanges, wherein each of said two horizontal member flanges overlap said second web;

at least two bracketing systems, each said bracketing system including a left bracket and a right bracket, said left bracket and said right bracket connected by an adhesive material, wherein said second web is designed to be attached directly to said at least two bracketing systems and designed to be flush with said at least two vertical members when assembled;

wherein said curved horizontal member flanges are designed to hook over said left and right bracket to reduce movement of said second member;

whereby each said bracketing system is mounted to each of said first vertical member by attachment means, and said second member is mounted to said bracketing systems between said two first vertical members.

2. The building construction assembly of claim 1 wherein each said bracketing system further includes:

said left bracket having a first left plate joined to a second left plate;

said right bracket having a first right plate joined to a second right plate;

said left bracket connected to said right bracket by said adhesive material that attaches to said second left plate and said second right plate, wherein said second left plate and said second right plate are substantially coplanar.

3. The building construction assembly of claim 2 wherein said second right bracket further includes said second right plate having a groove therein that runs substantially along its length parallel to said first right plate.

4. The bridge construction assembly of claim 2 wherein said second channel frame forms an outer boundary of an inner channel that runs substantially along the length of said second member, said inner channel is characterized as having an inner channel depth sized to fit said second right plate.

5. The building construction assembly of claim 4, wherein said inner channel has a depth substantially similar to the thickness of said second right plate.

6. The building construction assembly of claim 1, wherein said second web of said second member substantially abuts at least one of said at least two vertical members.

7. The building construction assembly of claim 3 wherein each said bracketing system further includes said left bracket having at least one notch in said second left plate.

8. A method for assembling a building construction comprising the steps of:

mounting a first bracketing system on a first vertical member;

wherein said first vertical member has two flanges joined by a first web to form a first channel frame, said first web having a first surface and a second surface; and, wherein said bracketing system includes a left bracket having a first left plate joined to a second left plate; a right bracket having a first right plate joined to a second right plate; said left bracket connected to said right bracket by an adhesive material;

mounting a second bracketing system on a second vertical member;

mounting a second member to at least one of said first bracketing system and said second bracketing system without mounting said second member directly to said first vertical member, wherein the second member has a second web and two horizontal member flanges horizontal flanges, and wherein said second web has a greater length than said two horizontal member flanges;

wherein said second member has two horizontal member flanges joined by a second web to form a second channel frame, said second web having a length greater than the length of each of said two horizontal member flanges.

9. The method for assembling the building construction of claim 8, further comprising the step of hooking said second member over said left bracket and said right bracket.

10. The method for assembling the building construction of claim 8 wherein mounting said first bracketing system on said first vertical member further comprise the steps of:

placing said left bracket on said first vertical member, with said first left plate mating with said first surface of said web of said first vertical member;

attaching said adhesive material to one said flange of said first vertical member;

wrapping said right bracket around said flange of said first vertical member, such that said first right plate mates with said second surface of said web of said first vertical member, and said second right plate is substantially coplanar with said second left plate;

securing said left bracket and said right bracket on said first vertical member by passing an attachment means through said first right plate, said web, and said first left plate.

11. The method for assembling the building construction of claim 8 wherein mounting said second member on said first bracketing system further comprises the steps of:

attaching said second member to said second right plate of said right bracket;

passing an attachment means through said second member and said second right plate, thereby securing said second member to said right bracket.

12. The method for assembling the building construction of claim 11 wherein mounting said second member on said second bracketing system further comprise the steps of:

attaching said second member to said second left plate of said left bracket;

passing an attachment means through said second member and said second left plate, thereby securing said second member to said left bracket.

13. The method for assembling the building construction of claim 10 wherein mounting said right bracket on said first vertical member further comprises the steps of:

mating said right bracket with said flange of said first vertical member;

wherein said right bracket has a first right plate joined to a second right plate, said second right plate having a groove therein that runs substantially along its length parallel to said first right plate;

mating said first right plate with said second surface of said web of said first vertical member, with said second right plate being substantially co-planar with said second left plate;

wherein said groove on said second right plate accommodates a lip on the flange of said first vertical member;

wherein said first left plate and said first right plate sandwiches said web of said first vertical member.

14. The method for assembling the building construction of claim 8 wherein mounting said second member on said first bracketing system further comprises the steps of:

applying said adhesive material to said first vertical member, whereby said adhesive functions to temporarily hold said left bracket and said right bracket in place with said first vertical member while an attachment means is used to secure said left bracket and said right bracket to said first vertical member.

* * * * *